US006200438B1

(12) United States Patent
Clasen et al.

(10) Patent No.: US 6,200,438 B1
(45) Date of Patent: Mar. 13, 2001

(54) CELL COVER FOR ELECTROLYTIC CELLS

(75) Inventors: Peter Clasen, Krefeld; Stefan Venghaus, Kalkar, both of (DE)

(73) Assignee: Bayer Aktiengesellschaft, Leverkusen (DE)

( * ) Notice: Subject to any disclaimer, the term of this patent is extended or adjusted under 35 U.S.C. 154(b) by 0 days.

(21) Appl. No.: 09/331,289

(22) PCT Filed: Jan. 3, 1998

(86) PCT No.: PCT/EP98/00018

§ 371 Date: Jun. 17, 1999

§ 102(e) Date: Jun. 17, 1999

(87) PCT Pub. No.: WO98/30737

PCT Pub. Date: Jul. 16, 1998

(30) Foreign Application Priority Data

Jan. 10, 1997 (DE) ..... 197 00 534

(51) Int. Cl.[7] ..... C25B 9/00

(52) U.S. Cl. ..... 204/279; 204/232; 204/242

(58) Field of Search ..... 204/232, 242, 204/279, 219, 250

(56) References Cited

U.S. PATENT DOCUMENTS

| | | | |
|---|---|---|---|
| 3,919,071 | 11/1975 | Mose | 204/219 |
| 4,087,343 | 5/1978 | Custer et al. | 204/286 |
| 4,283,263 | 8/1981 | Mirabelli | 204/219 |
| 4,443,315 | 4/1984 | Iijima et al. | 204/253 |

FOREIGN PATENT DOCUMENTS

| | | |
|---|---|---|
| 23 40 240 B2 | 3/1975 | (DE) . |
| 30 08 453 C2 | 9/1980 | (DE) . |
| 31 16 193 A1 | 2/1982 | (DE) . |
| 0655520 | 6/1995 | (EP) . |
| 1132282 | 10/1968 | (GB) . |

*Primary Examiner*—Bruce F. Bell
(74) *Attorney, Agent, or Firm*—Norris McLaughlin & Marcus

(57) ABSTRACT

Anti-corrosive apparatus cover with an improved detachable wall-covering for new or used covers of electrolytic cells.

10 Claims, 3 Drawing Sheets

Section A-A

Section A-A

CELL COVER FOR ELECTROLYTIC CELLS

The present invention relates to anti-corrosion apparatus covers, in particular cell covers for electrolytic cells, with an improved wall covering. The proposed simple detachable covering is particularly suitable for use in new or used covers of electrolytic cells operating according to the amalgam process.

BACKGROUND OF THE INVENTION

At least three different methods are known for lining metal electrolytic cell covers that are suitable for use in the amalgam process:

The application of a non-detachable rubber covering or lining to a conventional steel cover or internally lining the cover with non-detachable titanium sheets.

In addition plastics sheets may also be used to cover the cells (so-called "membrane covers").

The disadvantage of rubberised covers is that dioxin-containing and furan-containing reaction products can form on rubberised covers as the result of reaction with chlorine. A further disadvantage is the complicated and expensive maintenance of such covers. If a rubberised cover is to be relined, the rubber covering must first of all be brought to a state of brittle fracture, for example by subjecting it to cold, following which the rubber residues adhering to the cover have to be chiselled off.

Titanium-lined cell covers have the following disadvantages. The lining of steel covers with titanium sheets is fairly complicated and costly on account of the numerous welds on the anode ducts in the cell cover. Even if the titanium lining is only slightly damaged moist chlorine can come into contact with the cell cover, resulting in serious corrosion of the steel part. A proper skilled repair welding on the titanium lining is not possible on account of the deficient gas saturation of the gap between the titanium lining and corroded steel cover.

The replacement of a steel cover by a "membrane cover" of plastic material is very costly and difficult to implement in practice, since among other things the construction has to be altered for the current conduction. Besides, membrane covers have the disadvantage that they restrict the possibility of adjusting the anodes vertically.

SUMMARY OF THE INVENTION

The object of the invention is to provide an apparatus cover with an anti-corrosion lining that does not have the disadvantages of the known constructions, the cover being provided with a readily detachable lining of plastics material or metal. In particular provision should be made for current ducts, for example when the cover is used as an electrolytic cell cover.

This object is achieved according to the invention if the ducts for the anodes are installed, for example by welding, on prepared, i.e. cut to size, drilled or machined sheets of plastic or metal, in particular of titanium or titanium alloys. After the lining has been applied to the steel covers the anode sleeves are prevented from slipping out of the bores by means of suitable retaining devices, for example retaining sheets or screws.

The invention provides an apparatus cover with an anti-corrosion lining and at least one electric current duct, characterised in that the lining is joined in a secure and gas-tight manner to the current duct with a sleeve projecting above the cover wall, that the sleeve is secured by means of a detachable securement means to the cover wall, and that the space between the current duct and the sleeve is sealed by means of a detachable sealant, the current duct being electrically insulated with respect to the sleeve and the cover.

An additional sealant surrounding the sleeve and that prevents the escape of corrosive gases is preferably provided on the apparatus cover.

In a special embodiment the securement means for securing the sleeve on the cover is a clamping ring that engages in a groove on the sleeve, or a sleeve nut that engages in a thread on the sleeve.

In a further preferred variant the sealant on the current duct extends sufficiently far down so that it encloses and electrically insulates the current duct also in the interior of the sleeve.

An additional insulation layer of a closed-cell polymer foam, in particular a polyurethane foam, is preferably provided, for example in sheet form, between the lining and the cover wall.

The lining of the cover wall may be of plastics material, in particular polyvinylidene fluoride (PVDF), polytetrafluoroethylene-co-hexafluoropropylene (FEP), perfluoroalkoxy polymers (PFA) or PVC, PVC-HT, or of metal, in particular titanium or its alloys. The lining is particularly preferably of titanium.

Apart from being lined with metal sheets, e.g. of titanium, cell covers may as described above also be lined with plastics, for example PVDF, FEP, PFA, PVC. The large-area sheets of the lining and the sleeves for the anode ducts may be joined to one another under optimum conditions, for example by welding. The surface of the metal cell cover may be provided with an additional coating to prevent corrosion. DD paints or epoxy resins are particularly suitable as materials for such a coating.

Should the lining be damaged after removal from the cell cover, the lining can easily be repaired since it is readily detachable from the cell cover. The structurally influenced gap between the lining and cover also permits the leak-proofness and tightness of the lining to be checked.

The covers may additionally be provided on all sides with a suitable coating to prevent corrosion.

Tests with loose plastic linings have shown that, despite the high coefficient of thermal expansion of the plastic, they are also suitable for lining covers. If the detachable linings are of metal, all welding work can be carried out under optimum conditions.

The proposed detachable compounds are particularly suitable for lining metal covers of electrolytic cells for producing chlorine according to the amalgam process.

The invention also provides the use of the apparatus cover according to the invention as a housing cover for electrolytic cells, in particular for chlorine-alkali electrolysis, for example by the amalgam process.

BRIEF DESCRIPTION OF THE DRAWINGS

The invention is described in more detail hereinafter with the aid of the drawings, without however being restricted thereto as regards details.

DETAILED DESCRIPTION OF THE INVENTION

Example

Figure 1:
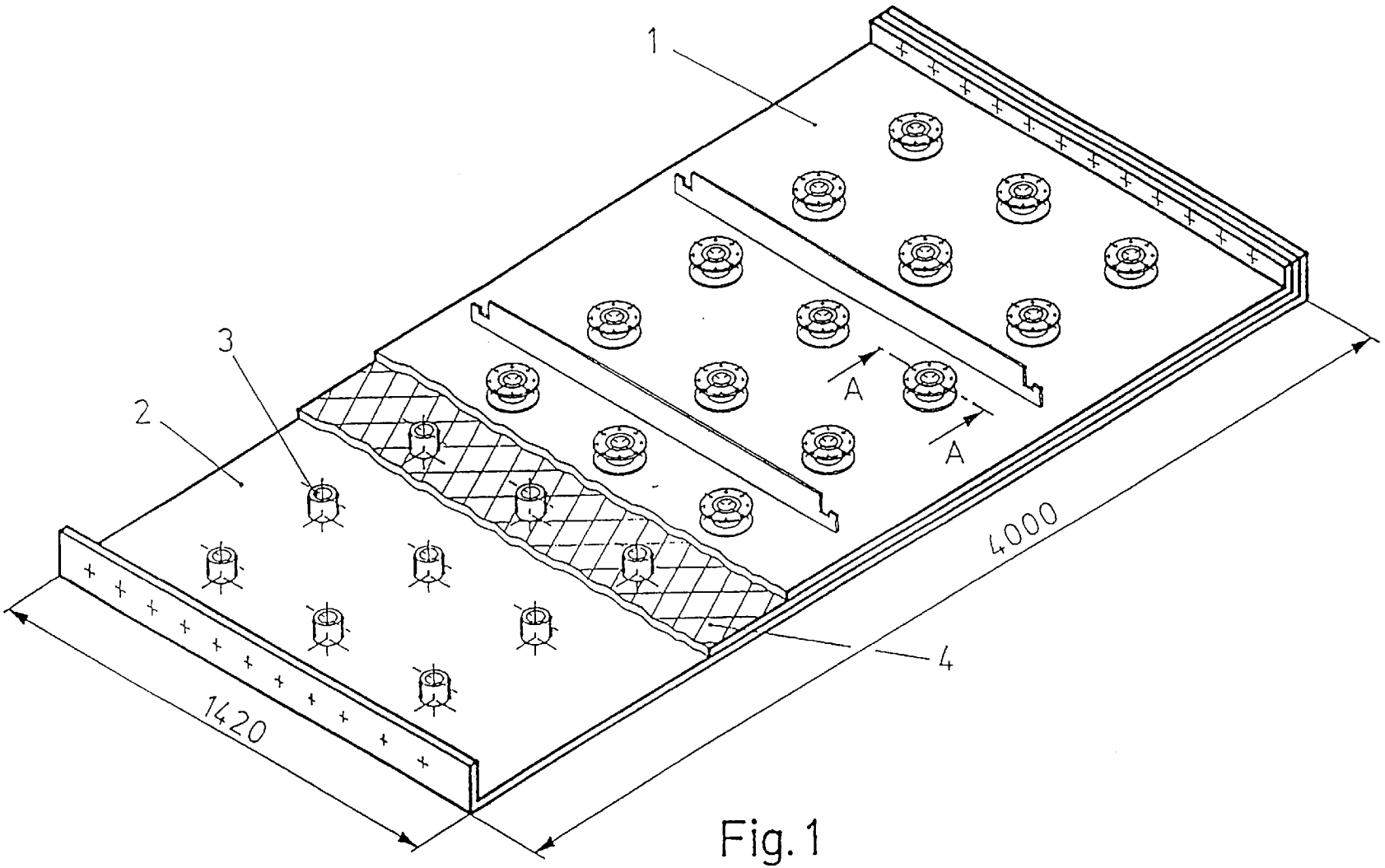
FIG. 1 is a side view of an embodiment of the apparatus cover according to the invention.

FIG. 1 shows a segment of a cover of an electrolytic cell in which chlorine is produced according to the amalgam process, with a loose lining 2 of plastic and a conventional anode duct 12 through the cover 1. In practice the sheet-like lining 2, for example of PVDF, FEP, PVC, is connected in a gas-tight manner, for example by welding, to the sleeve 5 for the anode duct 12 (see FIG. 2) before installation on the cell cover 1. The cell cover 1 is then placed on the lining 2, the sleeves 5 extending through bores 3 in the cover wall 1. An insulation 4 forming a barrier for harmful gases is in addition provided between the cell cover 1 and lining 2.

Figure 2:
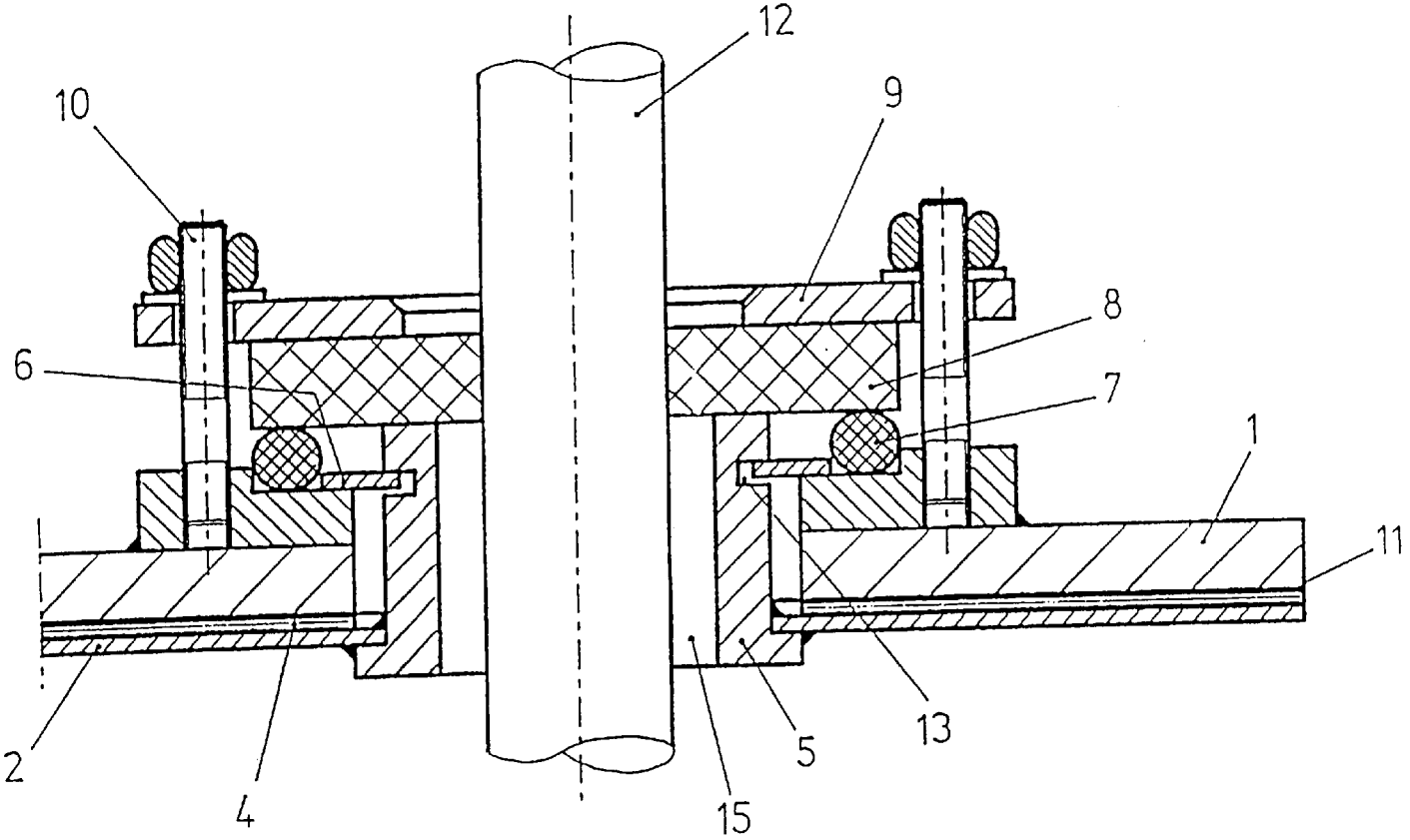
FIG. 2 shows a detail corresponding to a section A–A' in FIG. 1 in the region of the sleeve 5 and the current duct 12.

FIG. 2 shows a section through a sleeve 5 with an anode duct 12. Split holding means, for example clamping rings of plastic or metal engaging in a groove 13 in the sleeve 5, prevent the sleeves 5 slipping out from the bores 3 in the cover 1. Alternatively, the sleeves can for example also be prevented from slipping out by a screw connection 16, 17, (see FIG. 3). The anodes 12 are sealed for example by a rubber washer 8 pressed by means of the flange 9 and the screw connections 10 against the upper edge of the sleeve 5, in order for example to seal the reaction space from the environment. The further seal 7 is intended to prevent moisture penetrating between the lining 2 and cell cover 1, for example when cleaning the top of the cover. In order to prevent corrosion on the underside of the cover 1 the latter is provided with a suitable corrosion protection 11.

The same construction is also suitable for a lining based on metallic materials, for example containing titanium.

Figure 3:
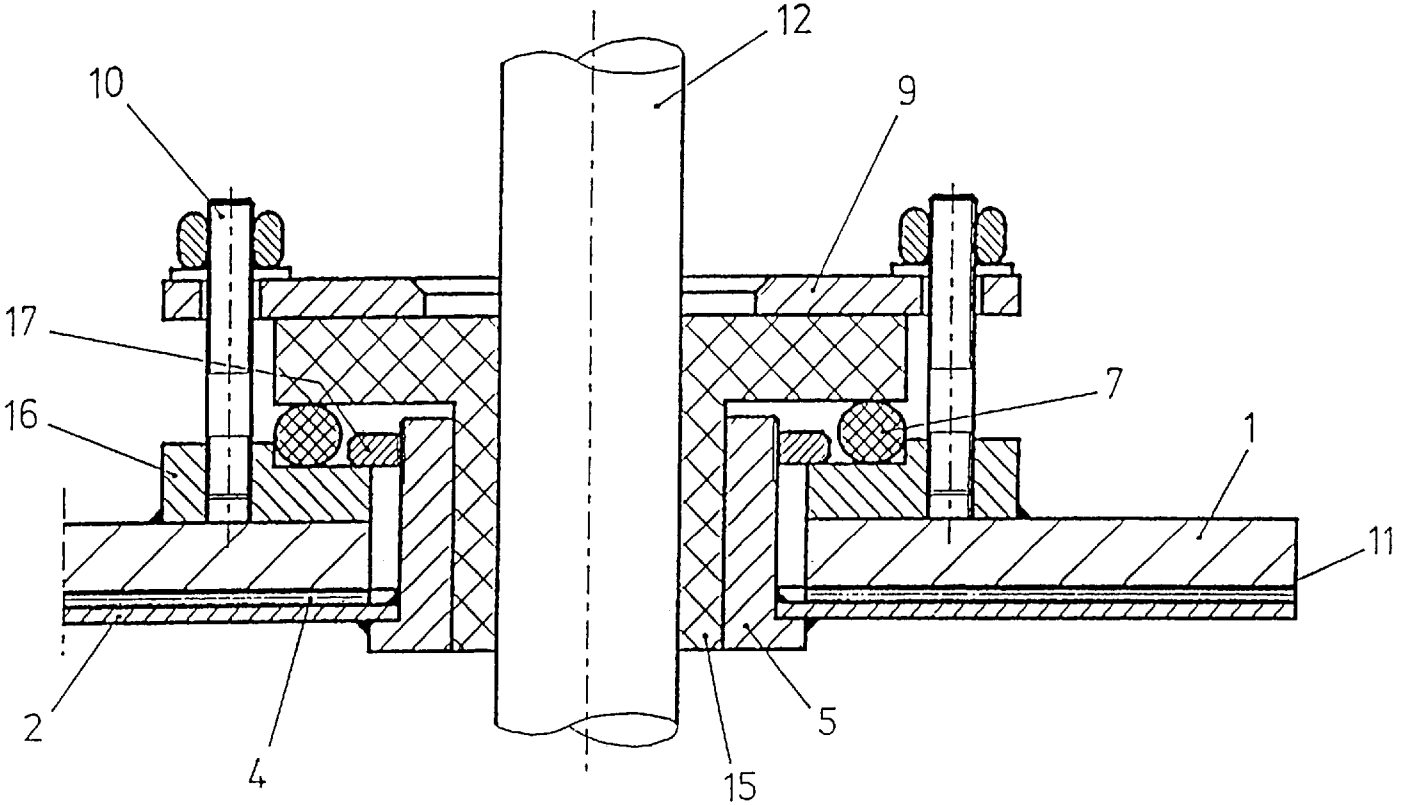
FIG. 3 shows an alternative detail corresponding to a section A–A' in FIG. 1 in the region of the sleeve 5.

FIG. 3 shows a section through a sleeve 5 with an anode duct 12, in which the sleeve is fixed by means of a sleeve nut 17. In this example the rubber seal is extended downwards in the interior 15 of the sleeve 5 in order to prevent a short-circuit between the duct 12 and the sleeve 5 when the latter is made of metal.

What is claimed is:

1. Apparatus cover with an anti-corrosion lining (2) consisting of a plastic material and at least one electric current duct (12), wherein the lining (2) is connected in a fixed and gas-tight manner to the current duct (12) with a sleeve (5) projecting above the cover wall (1), the sleeve (5) is secured with a detachable securement means (6) to the cover wall (1), and the space between the current duct (12) and the sleeve (5) is sealed by means of a detachable sealant (8), the current duct (12) being electrically insulated with respect to the sleeve (5) and the cover.

2. Apparatus cover according to claim 1, further comprising an additional sealant (7) surrounding the sleeve.

3. Apparatus cover according to claim 1 wherein the securement means (6) is a clamping ring that engages in a groove (13) on the sleeve (5).

4. Apparatus cover according to claim 1, wherein the securement means (6) is a sleeve nut (16) that engages in a thread (17) on the sleeve (5).

5. Apparatus cover according to claim 1, wherein the sealant (8) surrounds and electrically insulates the current duct (12) also in the interior (15) of the sleeve.

6. Apparatus cover according to claim 1, wherein an additional insulation layer (4) of closed-cell polymer foam.

7. The apparatus cover of claim 6, wherein said foam is a polyurethane foam.

8. Apparatus cover according to claim 1, wherein the underside of the cover (1) is provided with an additional corrosion protection layer (11).

9. A housing cover for electrolytic cells comprising the apparatus cover of claim 1.

10. The apparatus cover of claim 1, wherein said plastic material is selected from the group consisting of polyvinylidene fluoride (PVDF), polytetrafluoroethylene-co-hexafluoropropylene (FEP), perfluoroalkoxy polymers (PFA) and polyvinyl chloride (PVC).

* * * * *